US009273513B2

(12) United States Patent
Breznikar et al.

(10) Patent No.: US 9,273,513 B2
(45) Date of Patent: Mar. 1, 2016

(54) VERTICAL-LIFT DOOR ASSEMBLY AND LINTEL SEALING UNIT THEREFOR

(75) Inventors: Jože Breznikar, Vrhnika (SI); Norbert Hoefner, Landshut (DE); Hans-Joerg Kremser, Bruckberg (DE)

(73) Assignee: EFALEX Tor-und Sicherheitssysteme GmbH & Co. KG, Bruckberg (DE)

( * ) Notice: Subject to any disclaimer, the term of this patent is extended or adjusted under 35 U.S.C. 154(b) by 886 days.

(21) Appl. No.: 12/864,841

(22) PCT Filed: Feb. 6, 2009

(86) PCT No.: PCT/EP2009/000831

§ 371 (c)(1),
(2), (4) Date: Oct. 26, 2010

(87) PCT Pub. No.: WO2009/109274

PCT Pub. Date: Sep. 11, 2009

(65) Prior Publication Data

US 2011/0030278 A1 Feb. 10, 2011

(30) Foreign Application Priority Data

Feb. 6, 2008 (DE) ..... 10 2008 007 592

(51) Int. Cl.
*E06B 7/16* (2006.01)
*E06B 7/18* (2006.01)
(Continued)

(52) U.S. Cl.
CPC ..... *E06B 9/17076* (2013.01)

(58) Field of Classification Search
CPC ..... E06B 7/16; E06B 7/18; E06B 7/20; E06B 9/17076; E05Y 2900/106
USPC ..... 160/200, 201, 40; 49/197, 199, 49/303–315, 316, 321, 483.1
See application file for complete search history.

(56) References Cited

U.S. PATENT DOCUMENTS 423,739 A 3/1890 Cook
822,130 A 5/1906 Hussey
(Continued)

FOREIGN PATENT DOCUMENTS

CN 2239483 Y 11/1996
CN 1216084 A 5/1999
(Continued)

OTHER PUBLICATIONS

English translation of the international preliminary report on patentability (Chapter II). International Patent Application PCT/EP2009/000831, published Nov. 12, 2010, 6 pages (corresponds to U.S. Appl. No. 12/864,841).

(Continued)

*Primary Examiner* — Katherine Mitchell
*Assistant Examiner* — Jeremy Ramsey
(74) *Attorney, Agent, or Firm* — Fitch, Even, Tabin & Flannery, LLP

(57) ABSTRACT

The invention relates to a lifting door assembly comprising a lifting door, in particular a fast-moving industrial door, having a door leaf which in the closed condition of the lifting door covers a door aperture, and a door lintel sealing device disposed in the area of a door lintel and mounted so as to produce a sealing effect between the door leaf and the door lintel in a sealing position when the lifting door is in the closed condition. The lifting door assembly is characterized in that the door leaf is guided laterally such that in the open position, it is wound free of contact in the area of a door lintel, and in that in the sealing position, the door lintel sealing device rests on a horizontal lateral edge surface of the door leaf adjacent the door lintel. The invention further relates to such a door lintel sealing device. The invention allows to improve a lifting door assembly such that particularly reliable sealing may be obtained with it in the area of the door lintel.

25 Claims, 7 Drawing Sheets

(51) Int. Cl.
*E05D 15/00* (2006.01)
*E06B 9/17* (2006.01)

(56) References Cited

U.S. PATENT DOCUMENTS

| | | | | |
|---|---|---|---|---|
| 1,869,347 | A | 7/1932 | Johnson | |
| 2,069,665 | A | 2/1937 | Bouthillier | |
| 2,166,746 | A | 7/1939 | Bartel | |
| 2,749,582 | A | 6/1956 | Beck | |
| 2,820,516 | A | 1/1958 | Cookson, Jr. et al. | |
| 2,827,114 | A | 3/1958 | Stroup | |
| 2,855,989 | A | 10/1958 | Pritchard | |
| 3,027,937 | A | 4/1962 | Wilson | |
| 3,034,575 | A | 5/1962 | Stroup | |
| 3,331,158 | A | 7/1967 | Frakes | |
| 3,947,998 | A | 4/1976 | Matsubara | |
| 4,119,133 | A | 10/1978 | Wolf | |
| 4,250,941 | A | 2/1981 | McNally | |
| 4,320,793 | A | 3/1982 | Lindbergh | |
| 4,356,856 | A * | 11/1982 | Bengtsson | 160/209 |
| 4,880,046 | A | 11/1989 | Gesy | |
| 5,277,240 | A | 1/1994 | Epema et al. | |
| 5,377,784 | A * | 1/1995 | Walkowiak et al. | 187/336 |
| 5,394,924 | A | 3/1995 | Rejc | |
| 5,402,841 | A | 4/1995 | Tierney | |
| 5,484,007 | A | 1/1996 | Rejc | |
| 5,488,982 | A | 2/1996 | Rejc | |
| 6,076,589 | A | 6/2000 | Hormann | |
| 6,123,139 | A | 9/2000 | Kalempa et al. | |
| 6,662,848 | B2 * | 12/2003 | Goodman et al. | 160/84.02 |
| 2011/0030278 | A1 | 2/2011 | Breznikar et al. | |
| 2012/0312483 | A1 | 12/2012 | Letonje et al. | |

FOREIGN PATENT DOCUMENTS

| | | | |
|---|---|---|---|
| DE | 8802906 | U1 | 7/1989 |
| DE | 3901304 | A1 | 7/1990 |
| DE | 4015214 | A1 | 11/1991 |
| DE | 4015215 | A1 | 11/1991 |
| DE | 4015216 | A1 | 11/1991 |
| DE | 19745564 | A1 | 6/1998 |
| DE | 199 15 376 | A1 | 10/2000 |
| DE | 202 06 188 | U1 | 8/2003 |
| DE | 103 24 084 | A1 | 12/2003 |
| DE | 103 00 302 | A1 | 7/2004 |
| DE | 10339506 | A1 | 3/2005 |
| DE | 10348543 | A1 | 6/2005 |
| DE | 102004014350 | A1 | 11/2005 |
| DE | 102004063924 | A1 | 1/2006 |
| DE | 10 2008 007 592 | A1 | 8/2009 |
| EP | 0 769 605 | A2 | 4/1997 |
| EP | 1251236 | A2 | 10/2002 |
| EP | 0 769 605 | B1 | 5/2003 |
| FR | 2842243 | A1 | 1/2004 |
| FR | 2873153 | A1 | 1/2006 |
| JP | S36-58 | B | 1/1961 |
| JP | S37-32976 | B | 12/1962 |
| JP | S38-288 | B | 1/1963 |
| JP | H5-36069 | B | 9/1993 |
| JP | 2000-170461 | A | 6/2000 |
| JP | 2002-097864 | A | 4/2002 |
| JP | 2003-253976 | A | 9/2003 |
| WO | 2007/045423 | A1 | 4/2007 |

OTHER PUBLICATIONS

Notification of Reasons of Refusal for Japanese Patent Application No. 2010-545407 dated May 9, 2013 issued by the Japan Patent Office (2 pages), and informal English translation (3 pages).

PCT International Search Report of the International Searching Authority dated Mar. 3, 2011 for International Application No. PCT/EP2011/000202, 4 pages.

PCT International Preliminary Report on Patentability and Written Opinion of the International Searching Authority dated Sep. 7, 2012 for International Application No. PCT/EP2011/000202, 12 pages.

PCT International Search Report of the International Searching Authority dated Jan. 1, 2013 for International Application No. PCT/EP2012/003043, 4 pages.

State Intellectual Property Office of China, Notification of First Office Action dated May 6, 2014 for Chinese Patent Application No. 201180011466.6, pp. 1-11, and informal English translation, pp. 12-18.

Notification of Reasons of Refusal for Japanese Patent Application No. 2010-545407 dated May 9, 2013 (2 pages), and informal English translation (3 pages).

* cited by examiner

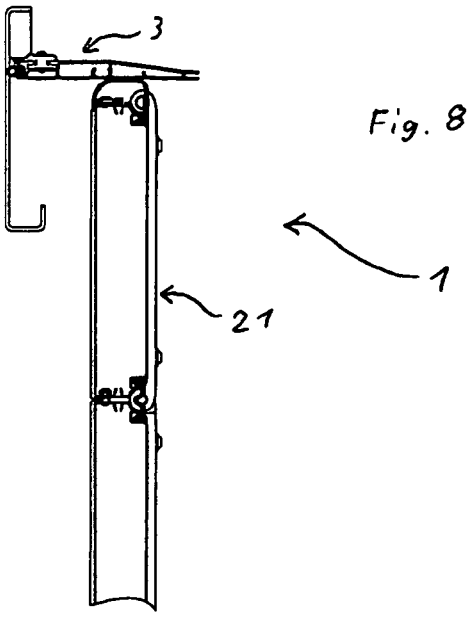
Fig. 8
Fig. 9
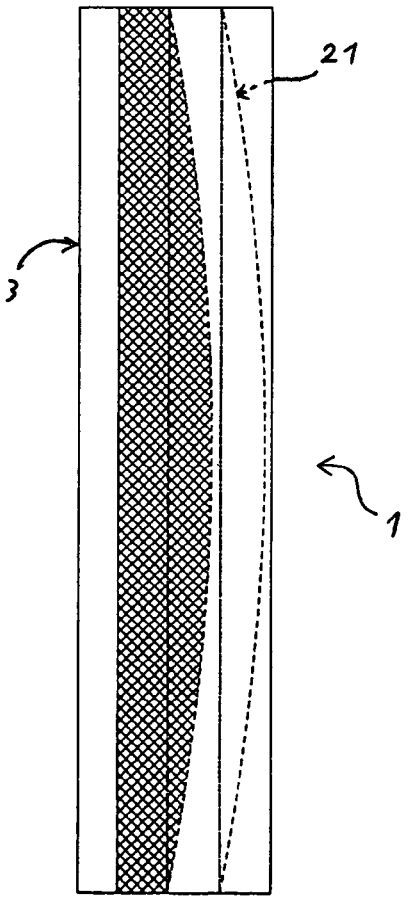
Fig. 10
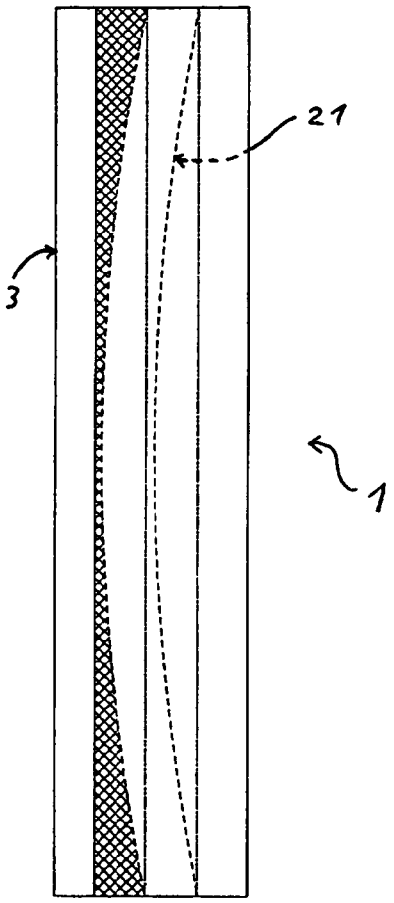

VERTICAL-LIFT DOOR ASSEMBLY AND LINTEL SEALING UNIT THEREFOR

CROSS REFERENCE TO RELATED APPLICATION

This application is a national phase application of International Application No. PCT/EP2009/000831, filed Feb. 6, 2009, designating the United States and claiming priority to DE 10 2008 007 592.2, filed Feb. 6, 2008, both of which are incorporated by reference herein in their entirety.

BACKGROUND

The invention relates to a lifting door assembly comprising a lifting door, in particular a fast-moving industrial door or gate having a door leaf which covers a door aperture when the lifting door is in the closed condition, and a door lintel sealing device arranged in the area of a door lintel and mounted so as to establish a seal between door leaf and door lintel in a sealing position when the lifting door is in the closed condition.

From practice, various manners of configuring lifting doors are known. Thus, lifting doors are variously employed wherein the lintel-side end of a segmented armor is fixedly connected to a winding shaft which is present in the area of the door lintel. In the open position of the door, the door leaf is present being wound on the winding shaft, with the coil layers being in contact with each other. There are furthermore known so-called sectional doors in which the door leaf comprised of sections is usually deflected in the door lintel area and guided alongside underneath the ceiling when the lifting door is moved into its open position.

On the other hand, lifting doors of the type disclosed, e.g., by German patent applications DE 40 15 214 A, DE 40 15 215 A, and DE 40 15 216 A are of particular interest for the present invention, with the fast-moving spiral doors described there being realized as a burglary-proof and weather-resistant external door. The door leaf of these lifting doors comprises a plurality of segments which are connected to each other in a manner allowing them to be inclined relative to each other. In the open position of the door, the segments are present free of contact in a coil at the upper side of the door aperture, i.e., in the area of the door lintel.

The door leaves of such lifting doors need to have sufficient stability in all three spatial axes in order to be able to function as a reliable closure of the door aperture. As such rolling doors frequently need to separate spaces of different temperatures, it is generally advantageous if they produce an effective thermal insulation. In this context, reliable sealing of the lateral marginal areas as well as in the area of the door lintel particularly also plays a crucial role.

Sealing in the area of the door lintel was particularly found to be problematic in practice, for there, the distance of the door leaf from the adjacent edge of the door lintel frequently is not constant across its entire width of the lifting door. Thus it was found that such door leaves quite frequently bulge inwardly or outwardly, resulting in a distinctly different spacing from the door lintel that in the center area of the door leaf and at the lateral marginal areas thereof. Such inward or outward bulging may be brought about by bending stresses owing to the own weight of the door leaf or also owing to other influence quantities such as, e.g., a wind pressure or wind suction. This problem also occurs particularly distinctly when the segments of the door leaf are so-called double-walled segments with thermal isolation of the segment walls.

One example of such an industrial door is described in EP 1 251 236 A2. Here the segment walls of these segments that are formed with double walls are connected to each other at their longitudinal edges by a respective web which is formed of a material having a lower thermal conductivity than the material of the segment walls so as to produce a thermal isolation of the segment walls. The segment walls are typically manufactured of an aluminum alloy, while the webs in these known rolling doors are generally formed of a plastic such as, e.g., PMMA, PVC, or PC. In order to improve the thermal insulation effect, the cavities in the segments formed in this manner may also filled with a foam-type insulation material such as, for example, PS. If, in the case of such double-walled segments, highly different temperatures are present on the two sides of the door leaf, which may be the case, for instance, if the outside of the door leaf is exposed to intense insolation while the inside is shaded or the inner space is cooled by air conditioning or a cooling apparatus, then different longitudinal elongations occur in the two walls of a slat. In this example, this may result in a considerable flexure of the door leaf towards the outside. The problem is exacerbated with increasing temperature differences and greater widths of the door leaf. At greater door widths of 6 m or more, for example, the deflection of such a thermally isolated segment out of the plane of the door leaf proper may amount to as much as 100 mm at the center.

Such spiral doors, or generally lifting doors having a door leaf guided free of contact in the area of the door lintel, are prone to this problem in a particular degree, for at its end face the door leaf is not attached to a winding shaft which is capable of opposing flexure. The situation is different with conventional rolling doors as addressed at the outset. In those cases the topmost segment is connected to the winding shaft, thus preventing a flexure in this location, and the entire door leaf is moreover additionally stabilized by the winding shaft. This is equally true if a deflecting roller is additionally provided in the area of the door lintel, as was proposed, e.g., by DE 10 2004 063 924 A1, for the deflecting roller will then have a stabilizing effect on the door leaf being in contact with it.

In order to be able to securely avoid a collision between the door leaf, which may bulge under certain circumstances, and the door lintel even in the case of lifting doors having a door leaf guided free of contact in the area of the door lintel, the door leaf accordingly must be arranged at a corresponding distance form the door lintel. This does, however, render reliable sealing between door leaf and door lintel even more difficult.

In practice, sealing lips attached in the area of the door lintel are for example used for this purpose, which sealing lips contact the outside of the door leaf by their free ends. As the distance between the door leaf and the door lintel is not constant across the entire width of the door leaf due to the mentioned bulge of the door leaf, this type of sealing presents the problem that the seal should be formed in such a way as to produce a reliable sealing effect irrespective of the actually spanned distance. On the one hand, the sealing lips must therefore at any rate be soft enough to sealingly contact the door leaf across the entire width of the door, irrespective of the distance to be sealed between door leaf and door lintel, while on the other hand having to have a sufficient strength so as to contact the door leaf at a sufficient elastic pressure, to thus avoid the formation of a gap. In practice, this is achieved only in a very unsatisfactory degree, so that a reliable sealing effect can not be obtained with this type of sealing in the area of the door lintel.

In an equally known sealing system including a modification, it is provided to dispose the sealing lips on the outside of the door leaf in the area of the topmost segment or section. This variant also had only limited success in practice, for here the sealing lips will bulge jointly with the door leaf and correspondingly present inhomogeneous contact with the door lintel or furnish varying contact pressure across the width of the door. The sealing effect is therefore also limited in this system. Sealing lips of this type may accordingly only be utilized to advantage where a deformation of the element to be sealed—in the present case the door leaf—does not occur or only occurs in a slight degree. In addition, providing the sealing lips on the outside of the topmost segment or section results in a widening of the door leaf in this area, so that it is hardly possible to wind it on a winding shaft free of contact. But even in the case of a door leaf that is wound free of contact such as, e.g., according to EP 1 251 236 A2, such sealing lips have an interfering effect, for the single coil layers must then be guided at a correspondingly great spacing from each other. This would necessitate undesirably large dimensioning of the spiral section which is hardly sensible in the lintel area in practice.

An alternative sealing system provides so-called brush seals. A door leaf bulging across the door's width, however, involves substantially the same problems in regard of a limited sealing effect as in the case of sealing lips. The bristles will either not be in sufficiently pressurized contact owing to an excessively large distance, or the very bristles are exposed to a risk of being damaged at a small distance and a high contact pressure. Such brush seals are likewise disposed either at the door lintel or at the topmost segment or section; with regard to their usability in particular with spiral doors exhibiting high operating frequencies as in the field of industrial field of use, they give rise to the same problems as sealing lip systems.

German laid-open publications DE 103 39 506 A1, DE 103 48 543 A1, DE 10 2004 014 350 A1, and DE 10 2004 063 924 A1 furthermore each disclose a lifting door which has a door leaf comprised of horizontally extending segments that are connected to each other with tensile strength and in a radially articulated manner, with the topmost segment being fixedly connected to a winding shaft arranged in the area of the door lintel. When this lifting door is opened, the door leaf is wound directly onto the winding shaft. In order to avoid scratching of the wound segments, a sealing band of a wear-resistant and noise-attenuating material is moreover wound jointly so as to come to lie between the single layers of the segmented armor in the coil. In this lifting door assembly, a lintel seal is furthermore provided which is mounted rotatably at the door lintel and is closed by a catch, or drive member, when the segmented armor is closed. As the door leaf is here fixedly connected to the winding shaft, the lintel seal finally is in contact at the outer surface, i.e., at a major surface of the door leaf.

More detailed information on the type and structure of this lintel seal is not found in these documents, while the problem of bulging of the door leaf across the width of the door is equally not addressed. Thus, this known lifting door also exhibits the problem that reliable sealing in the lintel area across the entire door width can not be ensured when the door leaf happens to bulge. In particular, this prior art does not furnish any suggestion how this sealing problem might be solved particularly in the case of a lifting door having a door leaf which is wound free of contact when the lifting door is in the open position, which is of particular interest for the present invention.

SUMMARY

The invention is therefore based on the object of further developing a lifting door assembly in such a way that reliable sealing in the area of the door lintel may be achieved with it.

This object is achieved through a lifting door assembly having the features of claim 1. In particular, the latter is characterized in that the door leaf is guided laterally such that in the open position it is wound free of contact in the area of a door lintel, and in that the door lintel sealing device rests on a horizontal lateral edge surface of the door leaf adjacent the door lintel in the sealing position when the lifting door is in the closed condition.

It was found in the framework of the invention that especially in the case of a spiral door having a door leaf which is wound free of contact when the lifting door is in the open position, it is possible to advantageously make use of the circumstance that the upper horizontal lateral edge surface or end-side surface of the door leaf comes to lie adjacent the door lintel when the lifting door is in the closed condition. This surface may be utilized directly for sealing the system, with possible bulging of the door leaf being insignificant, for in accordance with the invention the door lintel sealing device does is not rest against the outer surface of the door leaf as in the prior art, but on top against the lateral edge surface of the door leaf.

This realization mode provides the essential advantage of the sealing device reliably taking effect irrespective of the extent of a possible bulge, for bulging of the door leaf in a given case takes place in a direction which is contained within the plane of sealing. A possible bulge thus does not affect the sealing device per se while also not bringing about any deformation of the sealing means in this location. Merely the respective position of the location of contact in the overlap range between the upper horizontal lateral edge surface of the door leaf and the sealing device varies across the width of this sealing device in accordance with the extent of the bulge.

In accordance with the invention it is thus possible to produce a reliable sealing effect in the lintel area of a lifting door assembly, which effect is not dependent on the extent of a possible bulge of the door leaf owing, for example, to thermal influences. Due to a suitable choice of the width of the sealing device and thus of the overlap range existing at the location of contact of these elements, the variation of the distance of the door leaf from the door lintel is thus insignificant for the sealing effect.

The invention thus allows particularly reliable sealing in the area of the door lintel of a lifting door assembly.

Advantageous developments of the lifting door assembly of the invention are subject matter of dependent claims 2 to 15.

A sealing member extending across the entire width of the door may thus be present at the end of the door leaf adjacent the door lintel. This allows to achieve a particularly good sealing effect, while it is possible to mount the sealing member with low constructive complexity at the upper end of the door leaf, with the sealing member, irrespective of a possible bulge of the door leaf, moreover being present precisely in a position where the sealing effect should materialize. In a given case, this sealing member furthermore does not hamper winding of the door leaf in the area of the door lintel, for it hardly, or not at all, needs to protrude beyond the major surfaces, i.e., the inner and the outer surface of the door leaf.

In one realization variant, the door lintel sealing device may be mounted pivotally at the door lintel. Hereby it is possible to achieve reliable sealing in the area of the door lintel with low constructive complexity and in particular through a simple pivoting movement. Above all it is then only necessary to move particularly few parts.

The door lintel sealing device may be configured as a rigid flap which extends across the entire width of the door, whereby the sealing device is given a constructively particularly simple and reliable design. Both reliable operation and a good sealing effect are thus readily possible.

In one alternative realization mode, the door lintel sealing device may also be mounted at the door lintel in a vertically displaceable manner such that it may be lowered onto the horizontal lateral edge surface of the door leaf adjacent the door lintel in order to establish the sealing position. In this case the door lintel sealing device is only moved linearly, which can also be made possible at low constructive complexity. In addition this allows to readily obtain a very good sealing effect.

In still another embodiment, the door lintel sealing device may be configured in the manner of a window blind and may be movable across the horizontal lateral edge surface of the door leaf adjacent the door lintel. Hereby, too, it is possible to achieve reliable sealing of the lifting door assembly in the area of the door lintel, wherein it is possible to readily move the door lintel sealing device into and out of the plane of the door leaf with the aid of means that are known per se and variously gained acceptance, in order to assume and leave the sealing position.

It is furthermore also possible that a force component directed opposite to the sealing position acts on the door lintel sealing device. In this case the sealing device has a general tendency to rise from the upper horizontal lateral edge surface of the door leaf, whereby the operation of opening the door leaf is facilitated. In particular it is hereby possible to avoid damage to the sealing device in the course of the opening the lifting door in a more reliable manner.

A spring, in particular a compression spring, may be present in order to provide the force component, which is advantageous with a view to the use of time-proven elements and moreover results in a particularly reliable assembly.

Alternatively or additionally it is also possible to utilize a counterweight in order to provide the force component, whereby the constructive structure is simplified further.

When a drive means is provided at the door leaf, which in the course of closing this door leaf acts on the door lintel sealing device such as to take the latter into the sealing position, the sealing effect will be produced automatically in the course of the closing operation without the necessity of manual intervention. This has an advantageous effect on the operation of the lifting door assembly of the invention.

The drive means may be disposed in the area of the upper end of the door leaf so that it will co-operate with the door lintel sealing device precisely at the time when the door leaf already is about to reach the position of complete closure. The actuation distance thus is short and may be configured with low complexity in terms of construction.

The invention may especially be applied to particular advantage with a lifting door assembly in which the door leaf comprises a plurality of segments connected to each other in a manner allowing them to be inclined relative to each other, which segments are preferably configured to be double-walled with walls that are thermally isolated from each other, for particularly large bulges will occur in this case.

The door lintel sealing device may moreover be executed to be insulated and/or have thermally isolated walls. Hereby it is possible to obtain particularly good thermal and/or acoustic insulation in the area of the door lintel, thus allowing in particular to reduce energy losses, for example in the context of air-conditioning rooms.

It is of further advantage if the door lintel sealing device is heatable so as to allow a reliable operation particularly in combination with air-conditioned rooms. Above all it is hereby possible to more reliably prevent avoid the sealing device from freezing tight at the upper end of the door leaf.

The lifting door assembly of the invention may furthermore also comprise a sensor unit which detects the position of the door lintel sealing device and thus only permits to open or close the door when the door lintel sealing device does not have an interfering effect on the movement of the door leaf.

In accordance with another aspect of the present invention, according to claim 16 a door lintel sealing device for a lifting door assembly of the invention is provided. This door lintel sealing device may be mounted subsequently on existing lifting door assemblies as a retrofitting part and insofar constitutes a separately distributable unit.

Hereby it is possible to achieve the advantages indicated in the foregoing with regard to the lifting door assembly of the invention, with corresponding developments in accordance with dependent claims 17 to 25 furthermore being possible.

BRIEF DESCRIPTION OF THE FIGURES

The invention shall in the following be explained in more detail by way of practical examples and by referring to the figures of the drawing, wherein:

FIG. 8 is a schematic lateral view of the lifting door assembly of the invention in the area of the door lintel;

FIG. 9 is a top view of the door lintel sealing device with the door leaf present underneath it, with the door leaf bulging toward the door inner side; and FIG. 10 is a top view of the door lintel sealing device with a door leaf present underneath it, with the door leaf bulging toward the door outer side.

DETAILED DESCRIPTION

Figure 1:
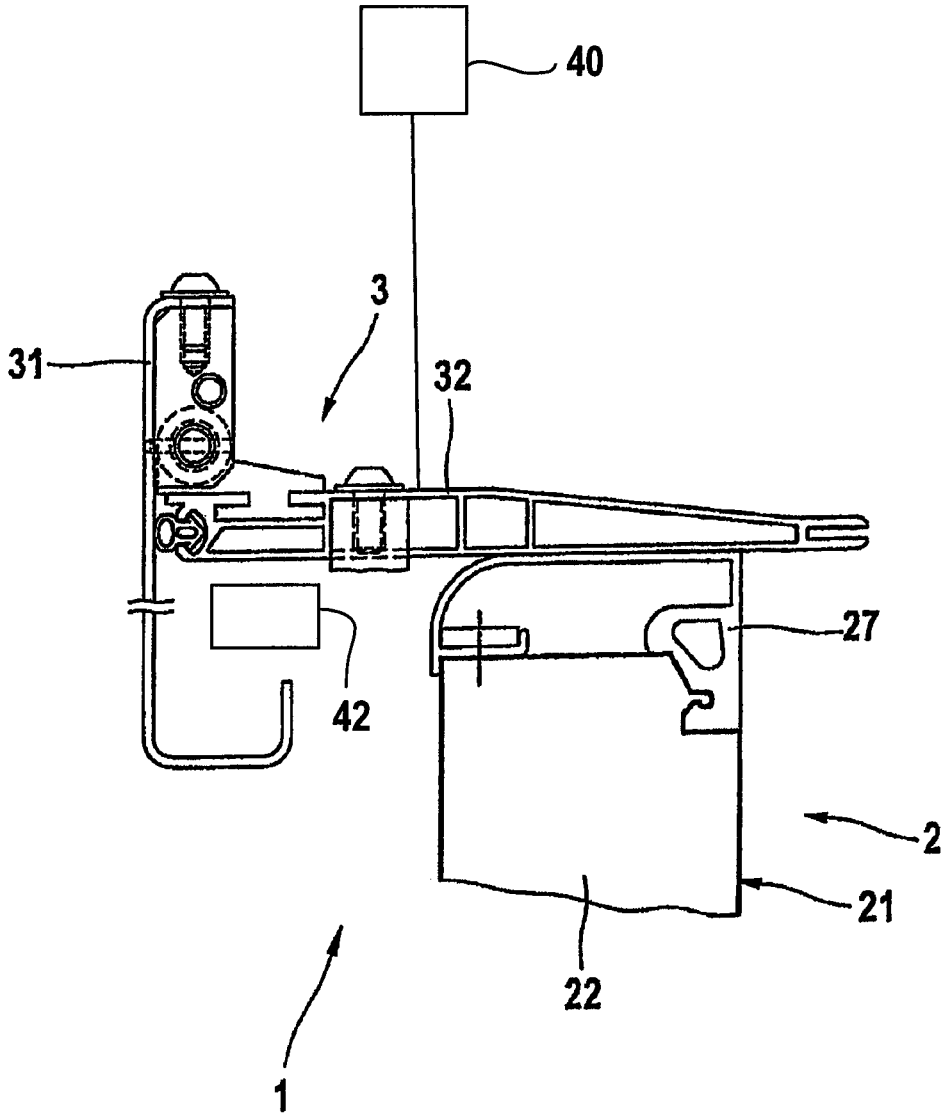
FIG. 1 is a lateral view of the portion of the lifting door assembly of the invention in the area of a door lintel that is essential for the present invention.

According to the representations in FIGS. 1 to 4, a lifting door assembly 1 in a first embodiment comprises a lifting door 2 as well as a door lintel sealing device 3. As may be seen in particular from FIGS. 1, 3, and 4, the lifting door 2 is configured in the manner of a segmented door and comprises a door leaf 21 having segments 22 that are connected to each other in a manner allowing them to be inclined relative to each other, which in the shown practical example are designed to be double-walled with thermally isolated segment walls. A topmost segment constitutes an upper terminating member of the door leaf 21. In the closed condition, the door leaf 21 altogether forms a plate-type body having two major surfaces, i.e., an outer surface and an inner surface of the door leaf 21, as well as four side surfaces each representing the respective outer edges of the door leaf body. One of the four side surfaces, namely, the upper horizontal lateral edge surface, is formed by the top edge of the upper terminating member.

The door leaf 21 is retained and guided by guide rolls 23 in lateral guide rails which are not represented here. The guide rolls 23 are mounted in hinge straps 24 provided on either side at the lateral edges of the door leaf 21 and interconnecting the segments thereof. The door leaf 21 of the lifting door 2 is guided in the lateral guide rails such that it may be moved during operation from the area of a door aperture into an area of the door lintel, and back. In the area of the door lintel, the door leaf 21 is usually guided past the inside of the door lintel, wherein the upper horizontal lateral edge surface thereof—in the following referred to as the end-side surface—comes to lie adjacent the door lintel when the door leaf 21 is in the closed condition.

Figure 2:
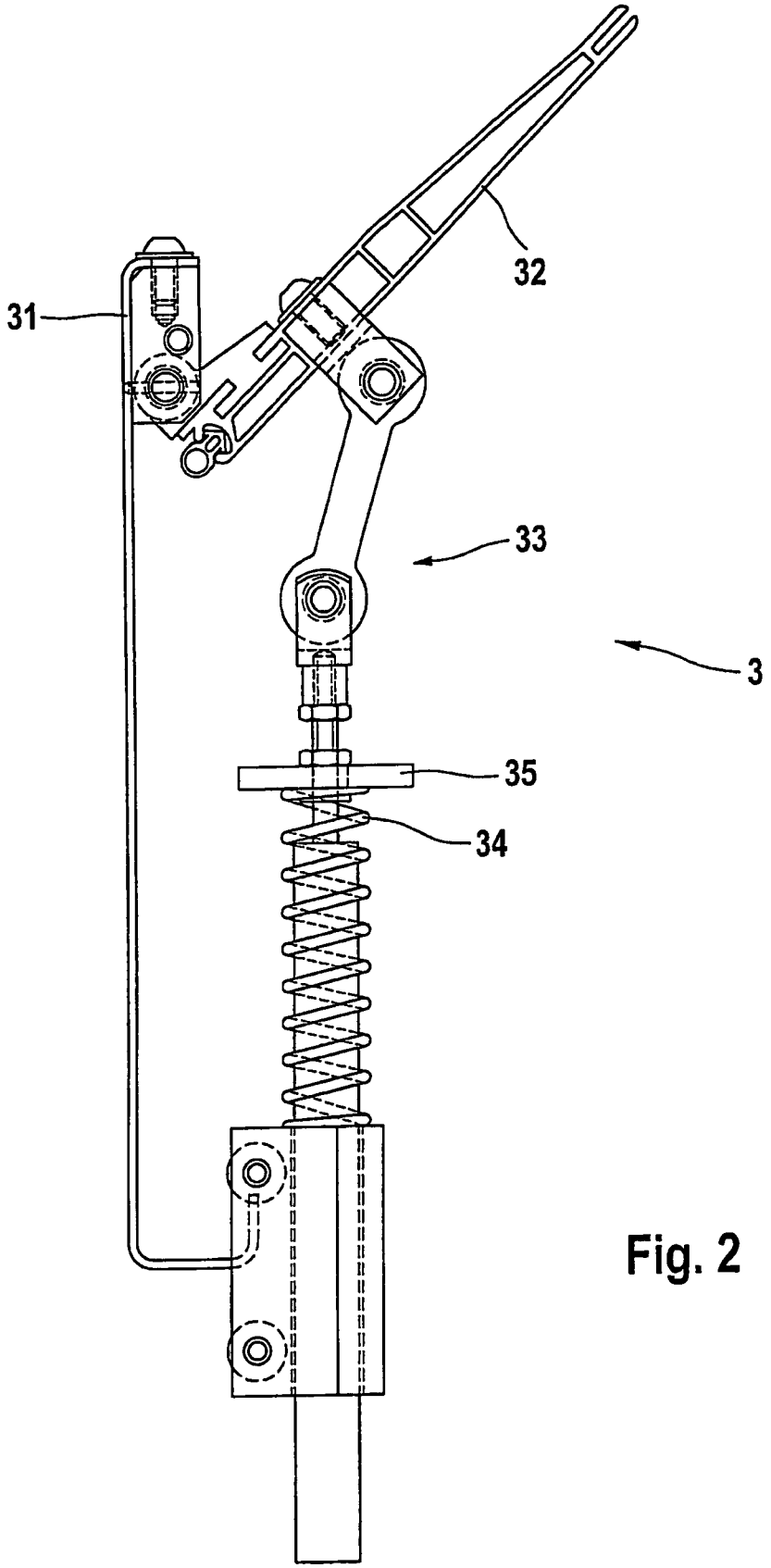
FIG. 2 shows the door lintel sealing device in further detail.

The sealing device 3 comprises a mounting device 31 whereby it is immobilized on a door lintel and in particular at the inner wall at the door lintel. In addition, the sealing device 3 contains a folding member 32 which is linked to the mounting device 31 in a foldable and pivotal manner and is present in the form of a rigid member extending across the entire width of the door. FIGS. 1 and 2 show the folding member 32 in a hollow profile configuration, while FIGS. 3 and 4 show a modified realization mode of a folding member 32' in which it is realized as a single-walled, planar member.

Figure 3:
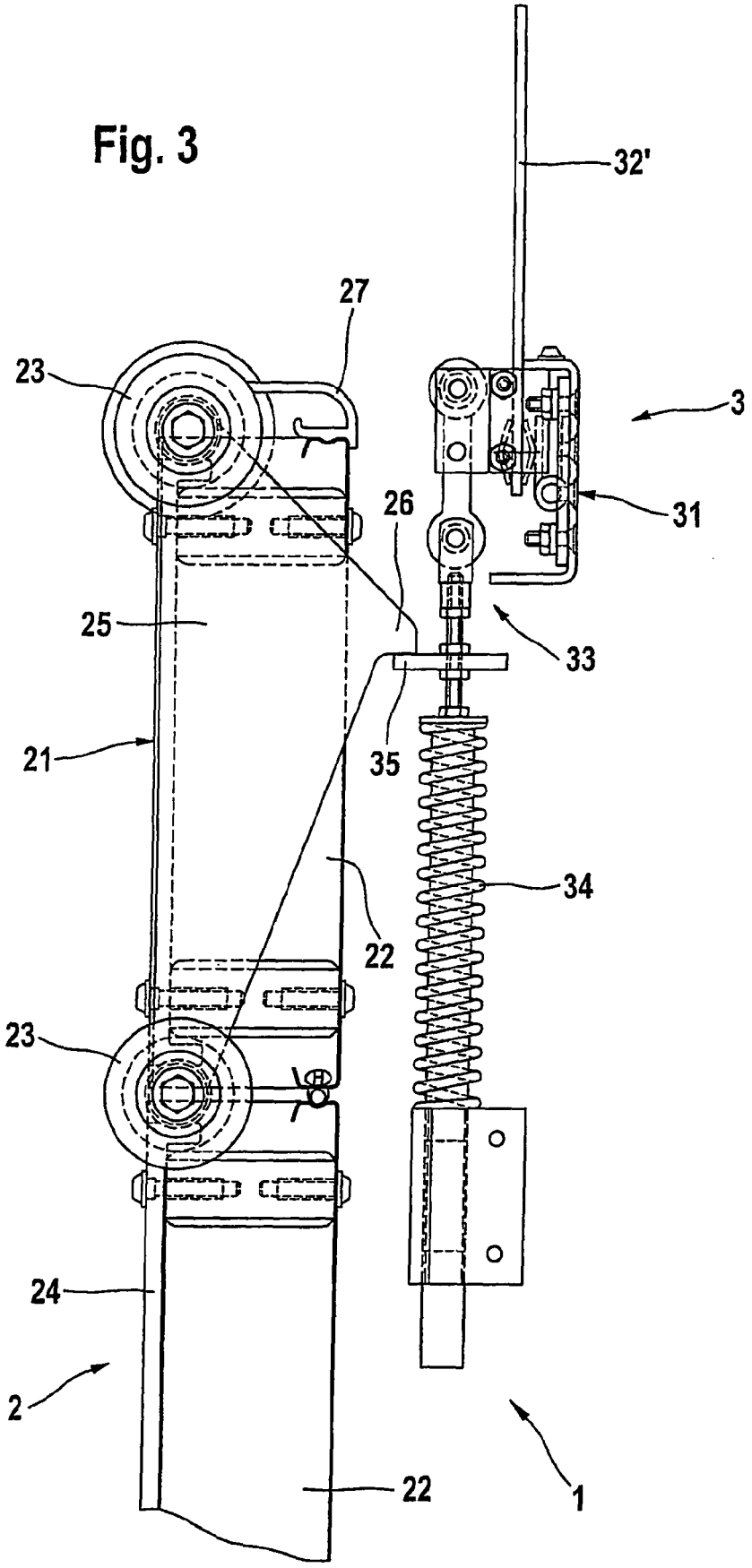
FIG. 3 is another lateral view focusing in particular on the drive means.
Figure 4:
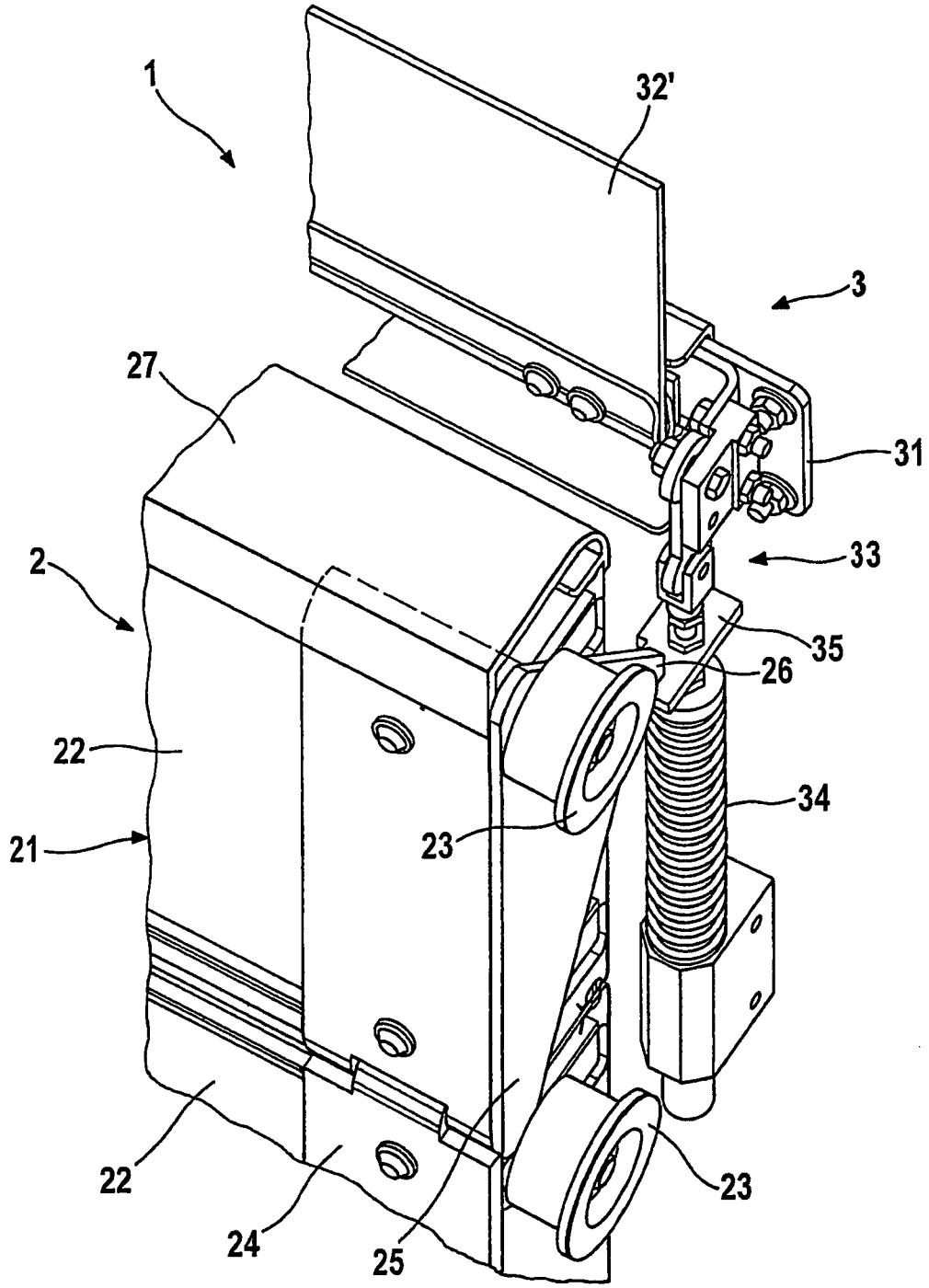
FIG. 4 is a perspective view of the configuration in FIG. 3.

Particular in FIGS. 2 through 4 an operating mechanism 33 for the sealing device 3 is visible which is configured in the manner of a lever mechanism. As may be seen from FIG. 3, the sealing device 3 is held in the rest position, i.e., in the position without a sealing effect, by the action of a compression spring 34.

At the operating mechanism 33 there is furthermore arranged a drive part 35 co-operating in the course of the closing operation of the door leaf 21 with a drive means 25 arranged there at the topmost segment 22 closest to the door lintel—the upper terminating member—in the manner shown in FIGS. 3 and 4. As may be seen here, a projection 26 of the drive means 25 engages the drive part 35 of the operating mechanism 33 in the course of the downward movement of the door leaf 21 and assists in pushing the latter away from the door lintel in a downward direction opposite to the spring force of the compression spring 34. As a result, the operating mechanism 33 becomes active, and the folding member 32 or 32' pivots downward over the topmost segment 22 situated closest to the door lintel so that it eventually comes to lie at the upper, horizontally oriented end-side surface of the closed and thus erect door leaf 21 in the manner shown in FIG. 1. The folding member 32 or 32' covers this upper end-side surface of the door leaf 21 to thus establish an upper termination of the door aperture. Alternatively or additionally, it is possible to utilize a counterweight, shown schematically at 40, to provide the force component.

In this position at the upper end face of the topmost segment 22, i.e., at the upper terminating member, a sealing member 27 in the manner of a hollow plastic seal is arranged in accordance with the representation in FIGS. 1, 3, and 4, and is fixedly connected to the topmost segment 22. In the shown example in accordance with the representation in FIG. 1, the sealing member 27 is on one side connected to the segment 22 by a screwed connection, and at the opposite side it is snapped onto a protrusion of latter by form closure. The folding member 32 or 32' thus comes to lie on the surface of the sealing member 27, as may in particular be seen in FIG. 1, to thus produce reliable sealing in the area of the door lintel.

As the folding member 32 or 32' thus overlaps the door leaf 21 at the top side thereof, it is furthermore not crucial for the sealing effect in this location whether or not the topmost segment 22 of the door leaf 21 bulges across the width of the door, for example owing to thermal influences or wind suction forces, for the folding member 32 or 32' will at any rate be in surface contact against the sealing member 27.

Figure 6:
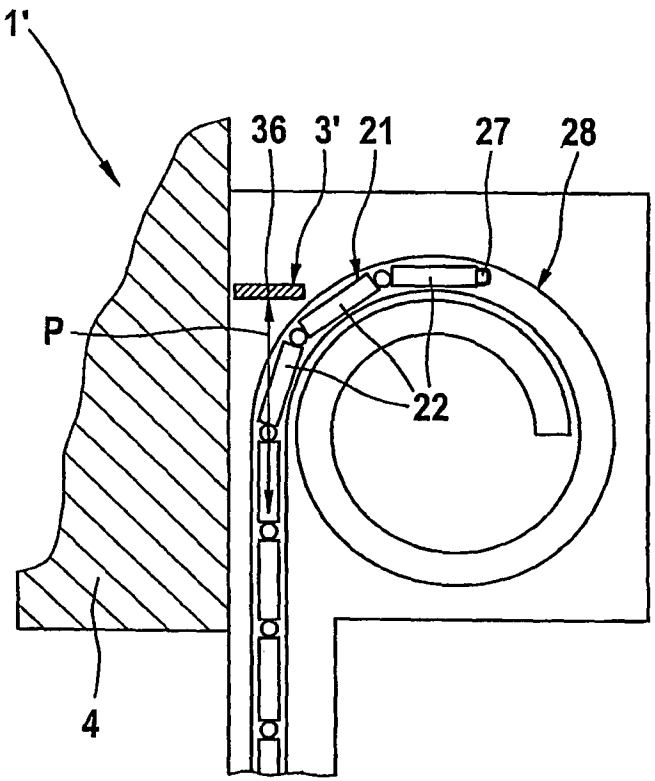
FIG. 6 is a schematic lateral view similar to FIG. 5, with the lifting door in the opening movement.
Figure 5:
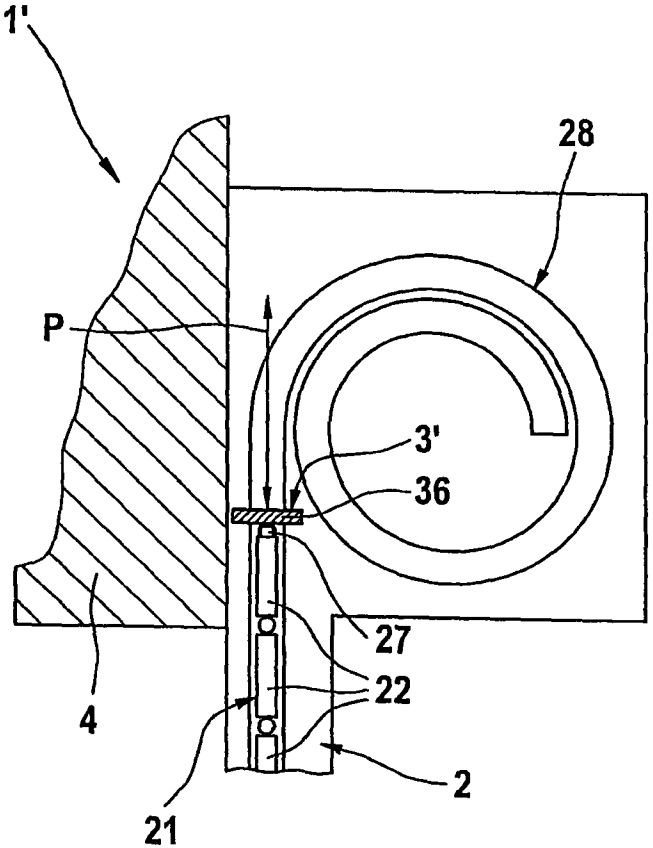
FIG. 5 is a schematic lateral view of an alternative embodiment of a lifting door assembly of the invention in the closed condition of the lifting door.

FIGS. 5 and 6 show schematic lateral views of a second embodiment of a lifting door means 1'. The latter also has a lifting door 2 and a sealing device 3'. What is shown in these figures is a detail in the area of a door lintel 4.

As may be taken from FIGS. 5 and 6, the lifting door 2 here equally comprises a door leaf 21 having segments 22. Furthermore, a sealing member 27 which co-operates with the sealing device 3' is again provided at the upper end of the door leaf 21. The door leaf 21 is guided on both sides in a door leaf guide means 28, with one of the two door leaf guide means 28 being visible in FIGS. 5 and 6. It is formed in the area of the door aperture by vertically oriented guide rails which merge into a spiral-shaped guide portion in the area of the door lintel. There, the door leaf 21 is wound free of contact.

The sealing device 3' is only indicated schematically in FIGS. 5 and 6 and comprises a sealing plate 36 which co-operates with the sealing member 27 at the door leaf 21 so as to produce a lintel seal. The sealing position is shown in FIG. 5. Here it should be noted that the sealing plate 36 at the same time is sealed against the door lintel 4 by a sealing member, in a manner which is not shown here. A double arrow P in FIG. 5 indicates the linear moving range of the sealing plate 36 of the sealing device 3'.

As may be seen in FIG. 6, the sealing plate 36 is raised upwardly and moved out of the moving range of the door leaf 21 in order to open the door leaf 21. When the door leaf 21 is closed, the sealing plate 36 is finally lowered again onto the upper end of the topmost segment 22 having the sealing member 27—the upper terminating member—present on it, and thus onto the upper lateral edge surface or end-side surface of the door leaf 21; similarly to the first embodiment, this movement may be effected or controlled, e.g., by a drive means or the like. In addition, the sealing device 3' may be operable in analogy with the first embodiment and may, e.g., also be biased against the sealing position by a force component.

Figure 7:
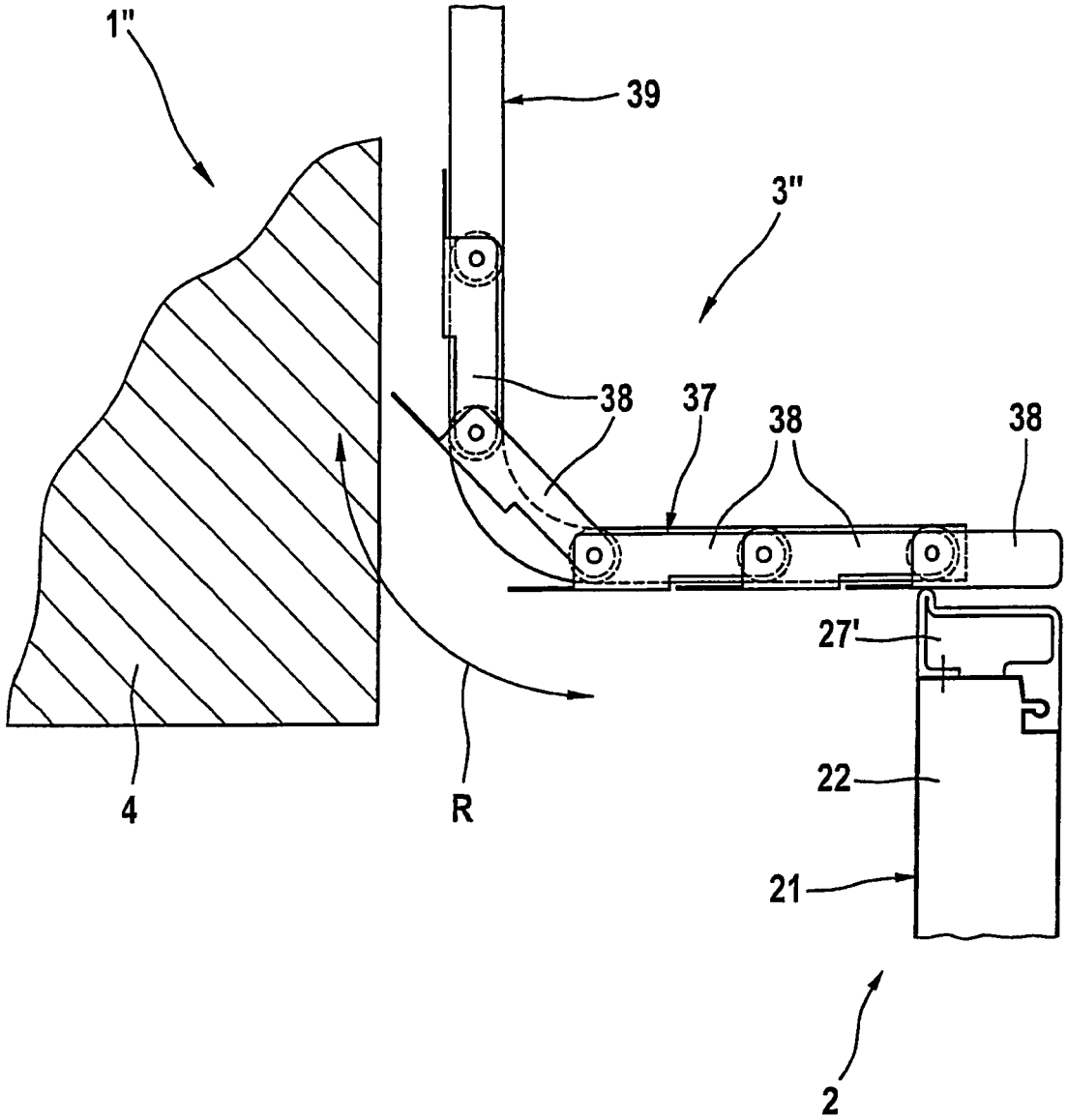
FIG. 7 is a schematic lateral view of another embodiment of a lifting door assembly of the invention.

FIG. 7 finally shows a third embodiment of a lifting door assembly 1" in accordance with the invention. It also comprises a lifting door 2 as well as a sealing device 3" arranged in the area of the door lintel 4.

The lifting door 2 in turn contains a door leaf 21 having segments 22, with a sealing member 27' again being positioned on the upper lateral edge surface of the topmost segment at the upper end face of the door leaf 21.

The sealing device 3" includes a blind 37 containing a plurality of blind segments 38 which are connected to each other in a manner allowing them to be inclined relative to each other. The blind 37 is guided on both sides in a blind guide means 39, with only one of the blind guide means 39 being indicated in the schematic lateral view according to FIG. 7. The blind 37 is moved in the manner shown by a double arrow R. Accordingly, it may be displaced over the upper end of the door leaf 21 or moved out of the plane of the door leaf, respectively. Operation of the sealing device 3" may take place, in analogy with the first embodiment, through the intermediary of a drive means or the like.

As may further be seen in FIG. 7, the sealing member 27' has a configuration in which a sealing lip is present on the side facing a sealing device 3", with the blind 37 sliding along the sealing lip so as to produce a reliable sealing effect in the sealing position. In the sealing position, the blind 37 rests, in a manner of speaking, on the sealing member 27' and thus on the upper end-side surface of the door leaf 21.

FIGS. 8 to 10 schematically show the effect of bulging of the door leaf 21. FIG. 8 shows a detail view of the lifting door assembly 1 in the area of the door lintel in the closed condition of the door lintel sealing device 3. In this example, the door leaf 21 has double-walled segments with thermal isolation of the segment walls.

FIG. 9 shows a top view of this assembly, with the door lintel sealing device 3 being visible from above, while the door leaf 21 is covered and therefore indicated by a dashed line. In this FIG. 9, the door leaf 21 exhibits a bulge toward the door inner side. This will occur, e.g., if freezing temperatures are present outdoors and the inner space is heated. As may particularly be seen from the comparison of the normal position of the door leaf without a bulge as represented in dash-two dot-lines, the flexure may assume a considerable extent. The gap to be sealed by the door lintel sealing device 3 is shown cross-hatched in FIG. 9. This gap is closed without any problems by the door lintel sealing device 3, for the latter rests on the upper end-side surface of the door leaf 21 and sufficiently covers it (cf. FIG. 8). The bulge thus does not result in an undesirable heat loss in the area of the door lintel owing to exchange of air, etc.

FIG. 10 finally shows a case in which the door leaf 21 bulges toward the door outer side, which will take place, e.g., if there is direct insolation on the outside while the inner space is cooled. Here, too, the gap to be sealed by the door lintel sealing device 3 is shown cross-hatched for clarity. As may be seen here, a gap portion bulging in such a way can hardly be sealed reliably by a sealing lip arrangement as in the prior art, for sealing lips are not capable of sufficiently covering such geometrical changes at the member to be sealed. By using the door lintel sealing device 3 in accordance with the invention, however, it is possible to reliably prevent a heat loss in the area of the door lintel, for owing to its constructive positioning above the end face of the door leaf 21, it does not have to cover a bulge of the door leaf.

Here it should be added that extent and direction of such a bulge of the door leaf 21 change depending on local circumstances, weather situation, seasons, etc. Irrespective of these, the door lintel sealing device 3 of the invention satisfies all of these requirements to furnish reliable sealing at the area of the door lintel at any time.

In addition to the discussed embodiments, the invention allows for further design approaches.

Thus it is furthermore also possible to provide a sealing member not at the upper, end-face end of the door leaf 21 but at the folding member 32 or 32', at the sealing plate 36, or at the blind 37, and/or at both of the participating members. In addition, the shape of the sealing member may also differ clearly from the shown realization variant; in particular it is also possible to dispose a single-walled, smooth and planar seal in this area instead of a hollow profile.

Where no particular demands are made to the sealing properties in the area of the door lintel, it may moreover even be sufficient if the folding member 32 or 32' etc. comes to lie directly on an upper side surface of a topmost segment 22, which then constitutes the end-side surface of the door leaf without a seal being arranged therebetween. In this case the sealing member may be omitted.

The door lintel sealing device preferably has the form of a rigid flap extending across the entire door width; apart from this it is, however, also possible to provided several folding levers arranged at a spacing from each other which are, e.g., interconnected via a sealing member extending across the width of the door. Hereby it would be possible to save weight, and in addition it would be possible to reduce the inertia of the sealing device during operation, and in particular also while the seal is lifted off in order to open the lifting door 2. The folding member 32 or 32' is preferably manufactured of a light metal such as, e.g., aluminum or an aluminum alloy, while on the other hand it is also possible to utilize a sturdy plastic material.

As an alternative it is, however, fundamentally also possible to prepare the folding member 32 or 32' of a plastic or rubber material having a sufficient inherent rigidity, such that this member is not rigid but elastic in a limited degree.

To the extent that opening of the sealing device 3, 3' or 3" may also be brought about in a different way such as, e.g., in the most simple case by operation of the door leaf 21, it is furthermore possible to omit the compression spring 34.

Likewise, the door lintel sealing device 3, 3' or 3" may also be operated in a way other than with the aid of a drive means. By way of example it is possible to use a motor operator, a lifting magnet etc., which causes the downward folding movement for sealing in the area of the door lintel in response to a corresponding electric signal or even by manual actuation. In this case it is possible to omit the discussed drive means 25 having an associated drive part 35.

In another modification it is furthermore possible for the drive means to also be disposed in any other location on the door leaf 21 so as to bring about the operation of the sealing device 3,3' or 3" from there.

The lifting door assembly 1, 1' or 1" may furthermore also comprise a sensor unit, shown schematically at 42, whereby the position of the door lintel sealing device 3, 3' or 3" may be detected, wherein it is also possible to bring about an operation of the sealing device by evaluating this sensor signal and the manner of operation or the position of the lifting door 2.

The door lintel sealing device 3, 3' or 3" may also be retrofitted on existing lifting doors 2 to improve the sealing effect there in the lintel area.

The invention claimed is:

1. A lifting door assembly comprising:

a lifting door having a door leaf including a top edge and a bottom edge, the lifting door movable between an open condition and a closed condition which covers a door aperture; and a door lintel sealing device pivotally coupled to a door lintel and mounted so as to produce a sealing effect between the door leaf and the door lintel in a sealing position when the lifting door is in the closed condition, wherein the door leaf is guided laterally such that in an open position, it is wound free of contact in the area of the door lintel, and in that in the sealing position, when the lifting door is in the closed condition, the door lintel sealing device rests on a horizontal lateral edge surface on the top edge of the door leaf adjacent the door lintel, wherein the door lintel sealing device pivots away from the horizontal lateral edge surface of the door leaf such that the door lintel sealing device does not contact the door leaf when the door leaf is moved from the closed condition to the open position.

2. The lifting door assembly according to claim 1, wherein a sealing member extending across the entire width of the door is present at an end of the door leaf adjacent door lintel.

3. The lifting door assembly according to claim 1, wherein the door lintel sealing device has the form of a rigid flap extending across the entire width of the door.

4. The lifting door assembly according to claim 1, wherein a force component directed opposite to the sealing position acts on the door lintel sealing device.

5. The lifting door assembly according to claim 4, further comprising a spring for providing the force component.

6. The lifting door assembly according to claim 4 further comprising a counterweight for providing the force component.

7. The lifting door assembly according to claim 1, wherein a drive means is provided at the door leaf, which in the course of closing the door leaf acts on the door lintel sealing device so as to enable it to reach the sealing position.

8. The lifting door assembly according to claim 7, wherein the drive means is provided in an upper end of the door leaf.

9. The lifting door assembly according to claim 1, wherein the door leaf comprises a plurality of segments connected to each other in a manner allowing them to be inclined relative to each other.

10. The lifting door assembly according to claim 1, wherein the door lintel sealing device is made to be insulated.

11. The lifting door assembly according to claim 1, wherein the door lintel sealing device is heatable.

12. The lifting door assembly according to claim 1, further comprising a sensor unit for detecting the position of the door lintel sealing device.

13. The lifting door assembly according to claim 1, wherein the door lintel sealing device is made to include thermally isolated walls.

14. A lifting door assembly comprising:

a lifting door which moves between an open and closed condition, the lifting door having a door leaf including a top edge and a bottom edge, the lifting door movable between the open condition and the closed condition which covers a door opening, and the door leaf having a horizontal upwardly facing lateral edge surface at the top edge when the lifting door is in the closed position; and a door lintel sealing device having a first portion operably coupled to a door lintel and a second portion pivotally attached to the first portion, the door lintel sealing device disposed in an area of a door lintel and mounted so as to produce a sealing effect between the door leaf and the door lintel in a sealing position when the lifting door is in the closed condition, the second portion pivoting into contact with the horizontal upwardly facing lateral edge surface when the lifting door is in the closed position and the second portion pivoting away from the horizontal upwardly facing lateral edge surface of the door leaf such that the door lintel sealing device does not contact the door leaf when the door leaf is moved from the closed condition to the open condition.

15. The lifting door assembly of claim 14 wherein the door leaf further includes a drive member which engages a portion of the door lintel sealing device so as to pivot the second portion into contact with the horizontally upwardly facing lateral edge when the lifting door is moved to the closed position.

16. The lifting door assembly according to claim 15, wherein the drive member is provided adjacent the top edge of the door leaf.

17. The lifting door assembly according to claim 14, wherein a sealing member extends across the entire width of the door at an end of the door leaf adjacent door lintel.

18. The lifting door assembly according to claim 1, wherein a force component directed opposite to the sealing position acts on the door lintel sealing device.

19. The lifting door assembly according to claim 18, further comprising a spring for providing the force component.

20. The lifting door assembly according to claim 18 further comprising a counterweight for providing the force component.

21. The lifting door assembly according to claim 14, wherein the door leaf comprises a plurality of segments connected to each other in a manner allowing them to be inclined relative to each other.

22. The lifting door assembly according to claim 14, wherein the door lintel sealing device is made to be insulated.

23. The lifting door assembly according to claim 14, wherein the door lintel sealing device is heatable.

24. The lifting door assembly according to claim 14, further comprising a sensor unit for detecting the position of the door lintel sealing device.

25. The lifting door assembly according to claim 14, wherein the door lintel sealing device is made to include thermally isolated walls.

* * * * *